US010662814B2

(12) United States Patent
Maliniak

(10) Patent No.: US 10,662,814 B2
(45) Date of Patent: May 26, 2020

(54) STATOR SHROUD SYSTEMS

(71) Applicant: United Technologies Corporation, Farmington, CT (US)

(72) Inventor: David Maliniak, Guilford, CT (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 391 days.

(21) Appl. No.: 14/929,813

(22) Filed: Nov. 2, 2015

(65) Prior Publication Data

US 2016/0123188 A1 May 5, 2016

Related U.S. Application Data

(60) Provisional application No. 62/074,135, filed on Nov. 3, 2014.

(51) Int. Cl.
*F01D 25/24* (2006.01)
*F01D 9/04* (2006.01)

(52) U.S. Cl.
CPC ..... *F01D 25/246* (2013.01); *F01D 9/04* (2013.01); *F01D 25/243* (2013.01); *F05D 2230/64* (2013.01); *F05D 2240/11* (2013.01)

(58) Field of Classification Search
CPC ..... F01D 9/04; F01D 17/16; F01D 17/162; F01D 25/24; F01D 25/243; F01D 25/246; F05D 2230/64; F05D 2240/11
See application file for complete search history.

(56) References Cited

U.S. PATENT DOCUMENTS

| | | | | |
|---|---|---|---|---|
| 2,452,227 | A * | 10/1948 | Dahlstrand | F01D 25/243 403/217 |
| 5,639,212 | A * | 6/1997 | Schaefer | F01D 11/001 415/173.1 |
| 6,655,911 | B2 * | 12/2003 | Bekrenev | F01D 9/042 415/116 |
| 6,742,987 | B2 * | 6/2004 | Correia | F01D 9/042 415/189 |
| 6,884,026 | B2 * | 4/2005 | Glynn | F01D 11/08 415/113 |
| 7,458,771 | B2 * | 12/2008 | Abadie | F01D 9/042 415/160 |
| 7,854,586 | B2 * | 12/2010 | Major | F01D 11/001 415/160 |
| 8,328,512 | B2 * | 12/2012 | Major | F01D 17/162 415/209.4 |
| 9,695,711 | B2 * | 7/2017 | Schaefer | F01D 25/243 |
| 2013/0129502 | A1 * | 5/2013 | Schaefer | F01D 25/243 415/214.1 |
| 2016/0123188 | A1 * | 5/2016 | Maliniak | F01D 25/246 415/209.4 |

* cited by examiner

*Primary Examiner* — Justin D Seabe
*Assistant Examiner* — Christopher R Legendre
(74) *Attorney, Agent, or Firm* — Cantor Colburn LLP

(57) ABSTRACT

A shroud for a turbomachine stator includes a first portion and a second portion configured to sandwich around at least a portion of a stator vane assembly, a first pin hole defined in the first portion at an angle relative to an axial direction of the turbomachine, and a second pin hole defined in the second portion at the angle of the first portion, wherein the first pin hole is aligned and in communication with the second pin hole to accommodate a pin configured to be seated in the first and second pin holes.

14 Claims, 5 Drawing Sheets

STATOR SHROUD SYSTEMS

CROSS REFERENCE TO RELATED APPLICATIONS

This Application claims the benefit of U.S. Provisional Patent Application Ser. No. 62/074,135 filed on Nov. 3, 2014 the entire contents of which are incorporated herein by reference thereto.

BACKGROUND

1. Field

The present disclosure relates to turbomachines, more particularly to stators of turbomachines and associated shrouds.

2. Description of Related Art

In certain turbomachines, shrouds can be disposed around stators to improve sealing between the rotor and the stator as well as to modify the gas path therein to increase efficiency. These shrouds are typically formed of two pieces that are connected together to sandwich stator structures therebetween. This two piece design has traditionally been joined together using a fastener that extends axially between stator vanes. However, as the number of vanes increases, less space is available for such fastening arrangements.

Such conventional methods and systems have generally been considered satisfactory for their intended purpose. However, there is still a need in the art for improved fastening systems for turbomachine stator shrouds. The present disclosure provides a solution for this need.

SUMMARY

In at least one aspect of this disclosure, a shroud for a turbomachine stator includes a first portion and a second portion configured to sandwich around at least a portion of a stator vane assembly. A first pin hole is defined in the first portion at an angle relative to an axial turbomachine direction. A second pin hole is defined in the second portion at the angle of the first portion, wherein the first pin hole is aligned and in communication with the second pin hole to accommodate a pin being seated in the first and second shroud portions.

The first pin hole can extend through the entire first portion such that a pin can be inserted from an outside surface thereof through the first portion and into the second pin hole of the second portion when the first and second portions are sandwiched around the stator. The first pin hole can have a larger diameter than the second pin hole such that the pin can be slid through the first pin hole but press fit into the second pin hole to secure the pin within the shroud.

In certain embodiments, the second pin hole can extend through the entire second portion such that a pin can be inserted from an outside surface thereof through the second portion and into the first pin hole of the first portion when the first and second portions are sandwiched around the stator. The second pin hole can have a larger diameter than the first pin hole such that the pin can be slid through the second pin hole but press fit into the first pin hole to secure the pin within the shroud.

The first portion can include a third pin hole disposed therein and the second portion includes a fourth pin hole disclosed therein, wherein the third pin hole is aligned and in communication with the second pin hole, wherein the third and fourth pin holes are disposed at a different angle than the first and second pin holes relative to the axial turbomachine direction.

The first pin hole can extend through the entire first portion such that a pin can be inserted from an outside surface of the first portion through the first portion and into the second pin hole of the second portion, and wherein the fourth pin hole extends through the entire second portion such that a pin can be inserted from an outside surface of the second portion through the second portion and into the third pin hole of the first portion when the first and second portions are sandwiched around the stator.

The shroud can further include a pin fit within the first and second pin holes. The pin can be made of a material with equal or greater thermal expansion than the first and second portions such that the pin is prevented from slipping out of the first and second pin holes when heated.

In at least one aspect of this disclosure, a method for assembling a shroud for a turbomachine stator includes placing a first portion and a second portion of a shroud together such that a plurality of first pin holes of the first portion align with a plurality of second pin holes of the second portion, wherein the pin holes align at an angle relative to a turbomachine axis, and disposing a plurality of pins within the first pin holes and second pin holes.

Disposing the pins can include inserting the pins through the first pin hole and into the second pin hole. In certain embodiments, disposing the pins can include inserting the pins through the second pin hole and into the first pin hole. Placing the first and second portions together can include placing the first and second portions around a stator.

In at least one aspect of this disclosure, a shroud for a turbomachine stator includes a first portion and a second portion configured to sandwich around at least a portion of a stator vane assembly, a plurality of first pin holes defined in the first portion, each first pin hole defined at an angle relative to an axial turbomachine direction, and a plurality of second pin holes defined in the second portion, wherein each first pin hole is aligned and in communication with each respective second pin hole to accommodate a pin configured to be seated in the first and second pin holes, wherein each second pin hole is defined at the angle of the respective first portion.

The plurality of first pin holes and second pin holes can be defined at a plurality of different angles relative to the axial turbomachine direction. A pin hole arrangement can include at least one first pin hole can allow insertion of a pin from a forward side through the first portion and wherein at least one second pin hole can allow insertion of a pin from an aft side through the second portion. The pin hole arrangement can alternate circumferentially along the shroud. In certain embodiments, the first pin holes that allow forward side insertion of the pins can be angled at a first angle and the second pin holes that allow aft side insertion can be angled at a second angle different from the first angle.

These and other features of the systems and methods of the subject disclosure will become more readily apparent to those skilled in the art from the following detailed description taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

DETAILED DESCRIPTION

Figure 1:
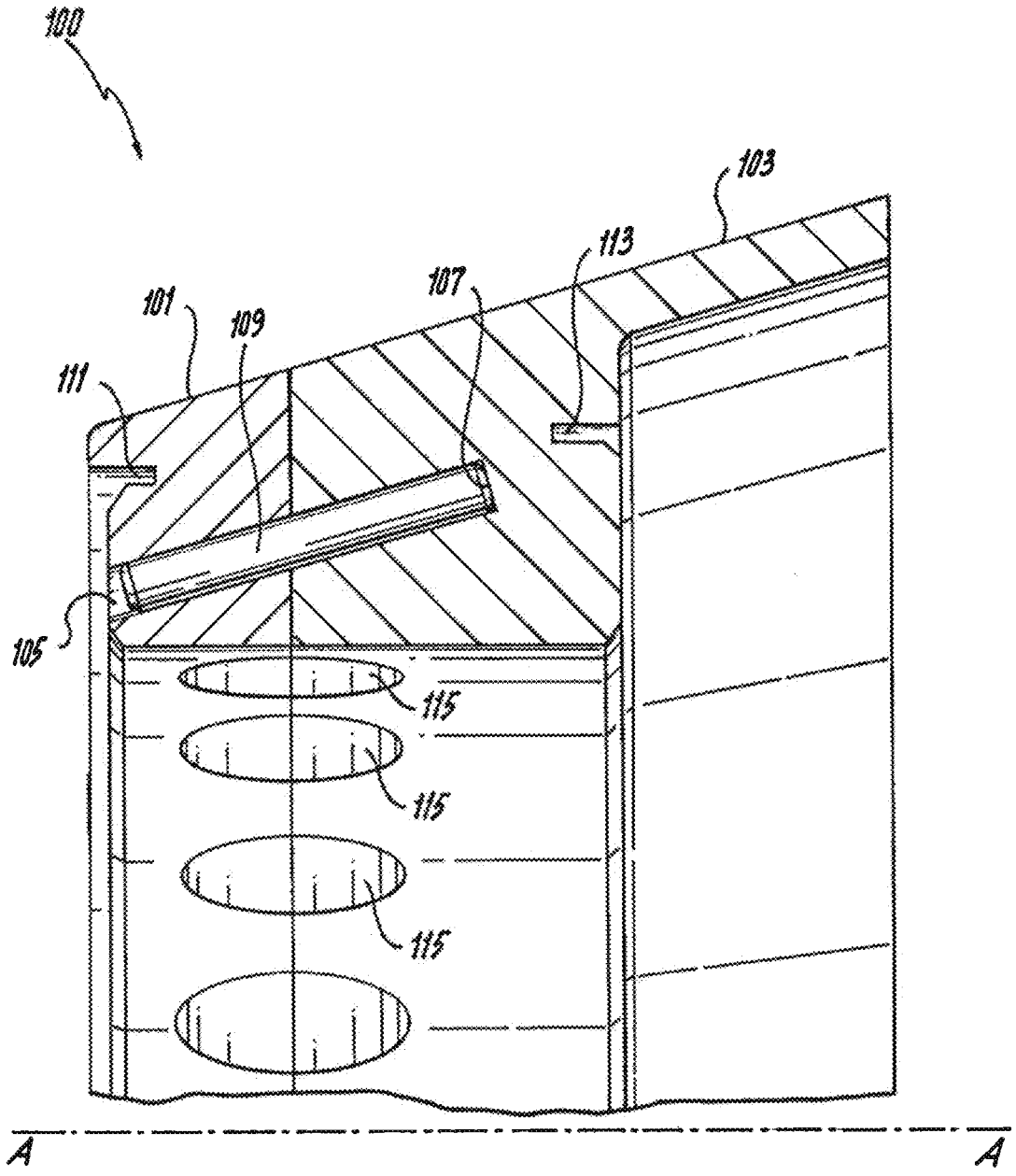
FIG. 1 is a cross-sectional side elevation view of an embodiment of a shroud in accordance with this disclosure, showing pin holes aligned at a first angle relative to a turbomachine axis and allowing pin insertion from the forward side.
Figure 2:
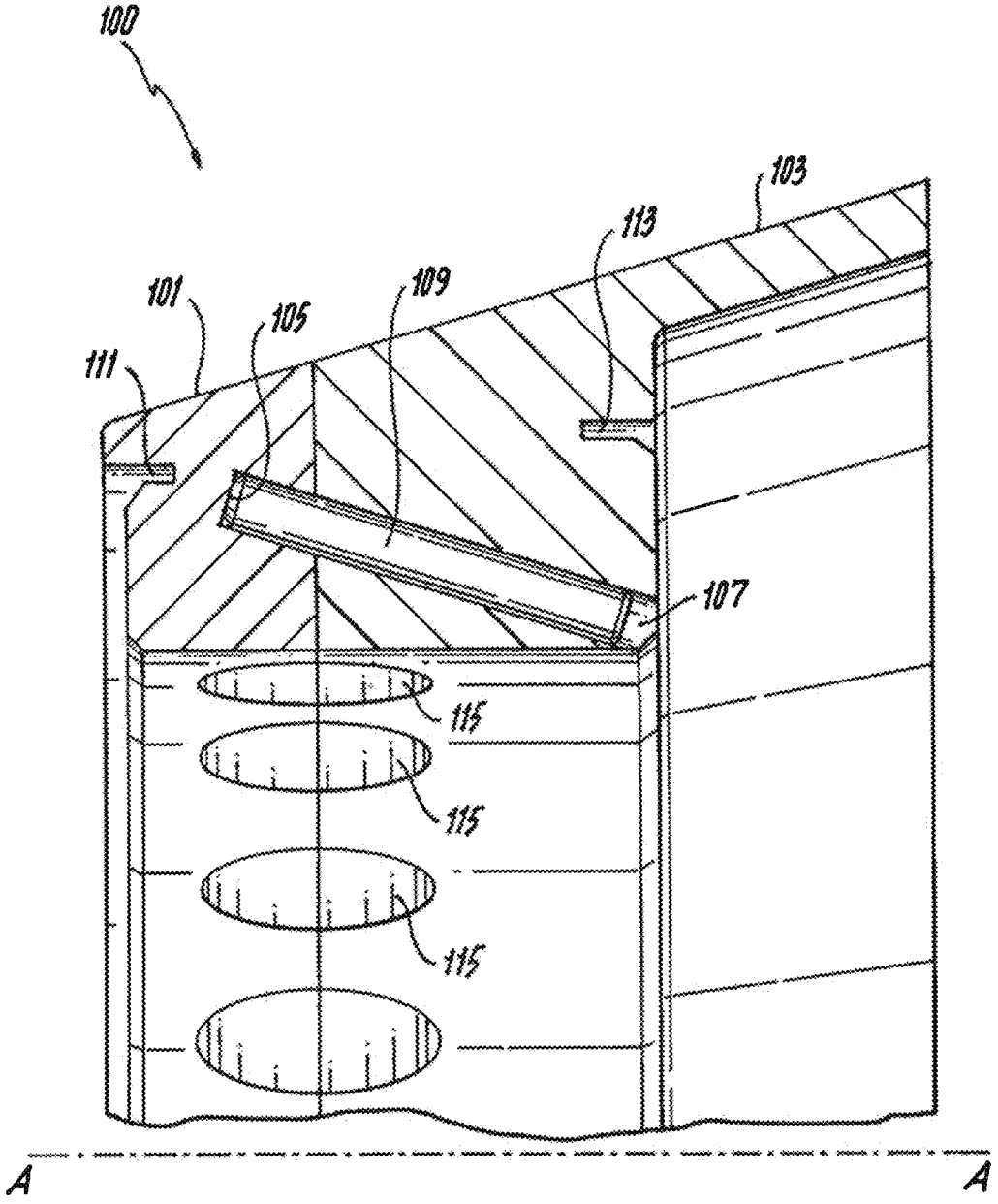
FIG. 2 is a cross-sectional side elevation view of another portion of the shroud of FIG. 1, showing pin holes aligned at a second angle relative to a turbomachine axis and allowing pin insertion from the aft side.
Figure 3:
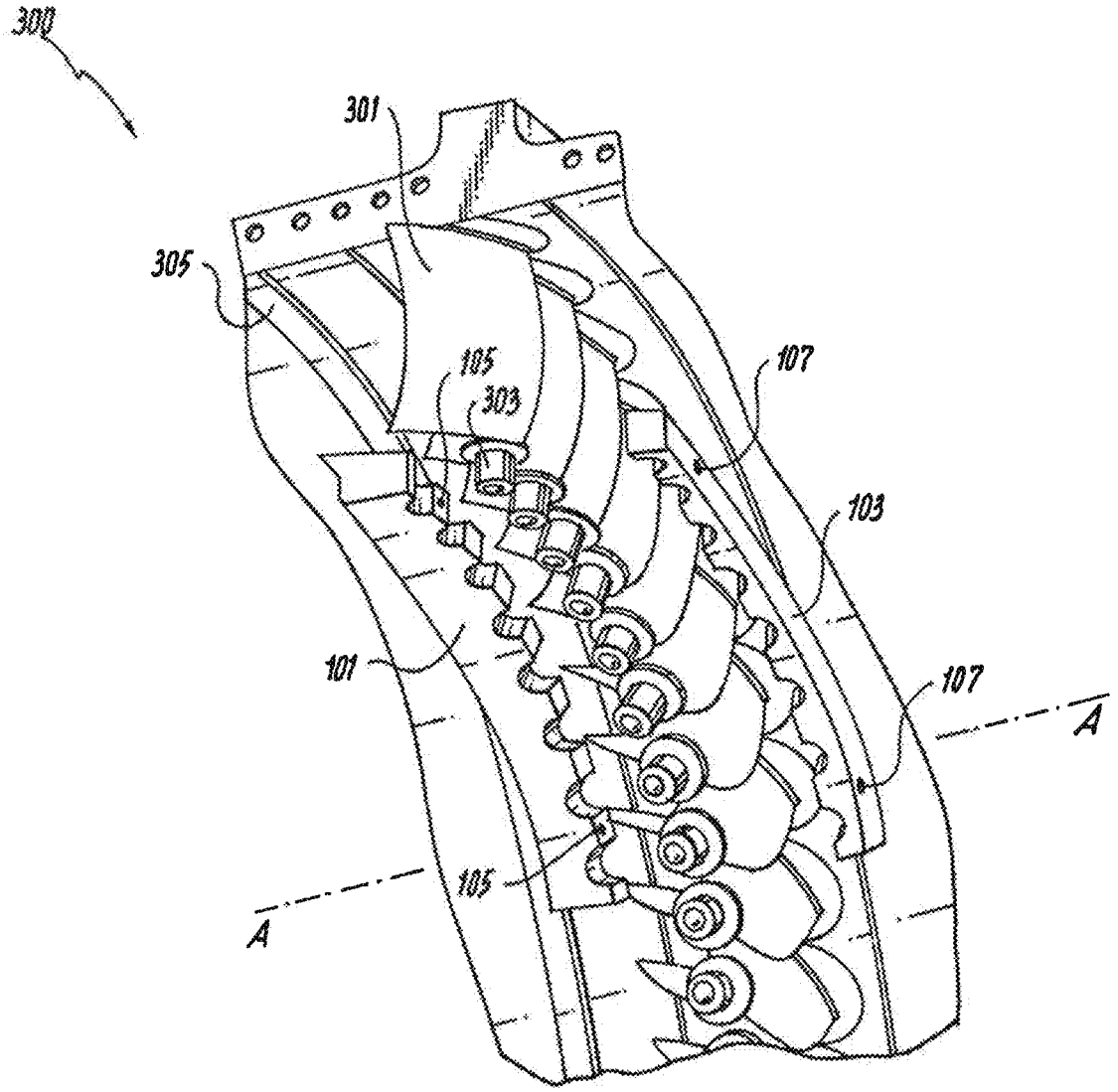
FIG. 3 is an exploded, cross-sectional perspective view of a stator vane assembly showing a shroud in accordance with this disclosure.
Figure 4:
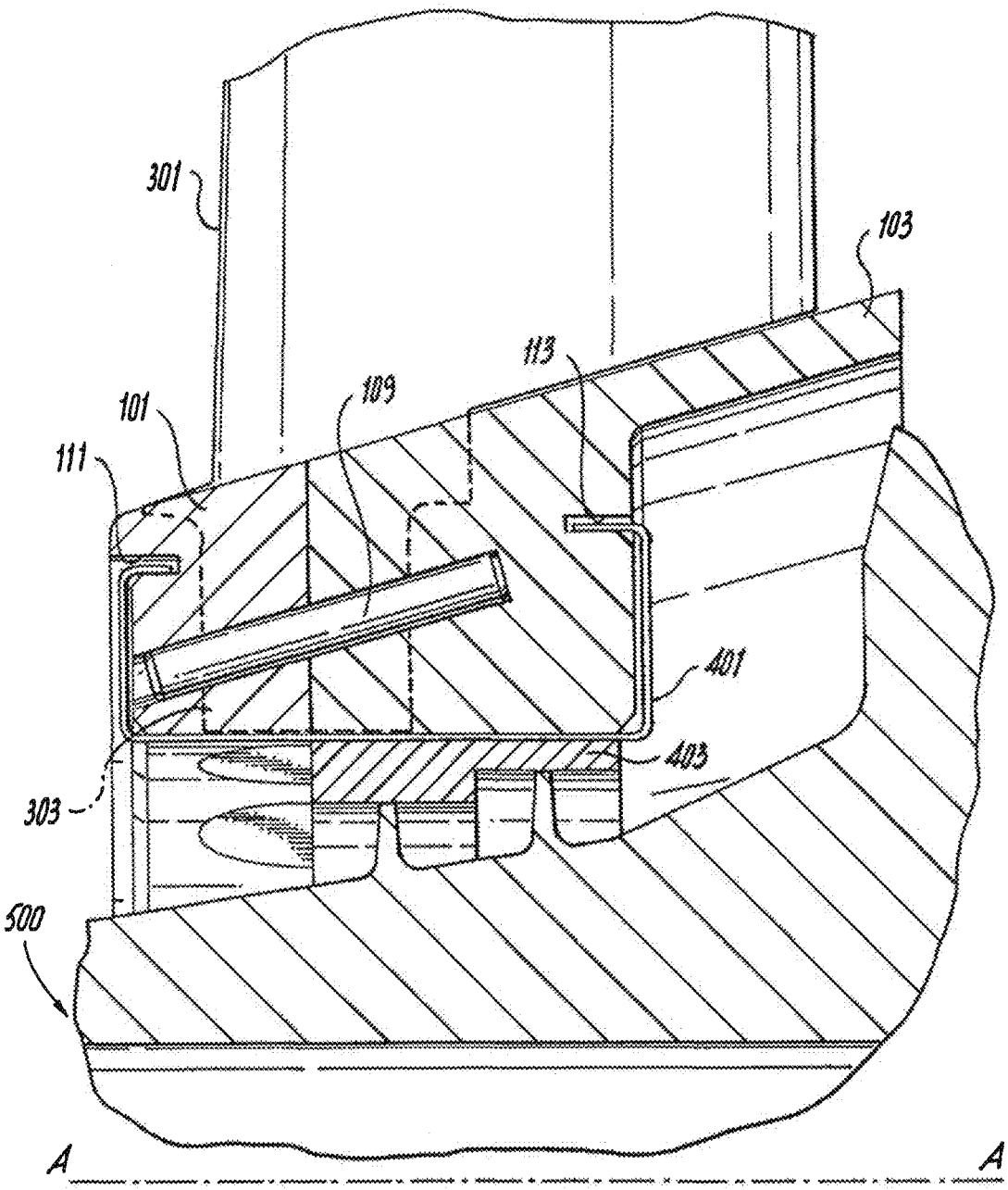
FIG. 4 is a cross-sectional schematic view of an embodiment of a shroud in accordance with this disclosure, showing the shroud disposed around a stator vane.

Reference will now be made to the drawings wherein like reference numerals identify similar structural features or aspects of the subject disclosure. For purposes of explanation and illustration, and not limitation, an illustrative view of an embodiment of a shroud in accordance with the disclosure is shown in FIG. 1 and is designated generally by reference character 100. Other aspects and/or embodiments of this disclosure are shown in FIGS. 2-4. The systems and methods described herein can be used to secure a shroud to a stator vane assembly.

In at least one aspect of this disclosure, referring to FIGS. 1-4, a shroud 100 for a turbomachine stator includes a first portion 101 and a second portion 103 configured to sandwich around at least a portion of a stator vane assembly (e.g., as shown in FIGS. 3 and 4). The shroud 100 can include a suitable annular shape, and can comprise any suitable portion of the annulus (e.g., 60 degrees, 90 degrees, 120 degrees, 360 degrees) and can include a plurality of stator vane holes 115 for receiving a portion of a stator vane.

A first pin hole 105 is disposed in the first portion 101 at an angle relative to a turbomachine axis A-A, shown schematically in FIGS. 1 and 2. A second pin hole 107 is disposed in the second portion 103 at the same angle as the first pin hole 105 of the first portion 101. In such an arrangement, the first pin hole 105 is aligned and in communication with the second pin hole 107.

A plurality of first pinholes 105 and second pin holes 107 can be circumferentially or annularly spaced apart on the first portion 101 and the second portion 103, respectively. As shown in FIG. 1, the first pin hole 105 and second pin hole can be aligned along any suitable angle (e.g., between about 15 and about 75 degrees inclined relative to axis A-A). On the same shroud 100, additional pin holes 105, 107 can be included at a second angle (e.g., between about 15 and about 45 degrees declined relative to axis A-A) as shown in FIG. 2. Any suitable combination of pin holes aligned at differing angles on a single shroud 100 or section thereof is contemplated herein.

Also as shown in FIG. 1, in certain embodiments, the first pin hole 105 can extend through the entire first portion 101 such that a pin 109 can be inserted from an outside surface of the first portion 101 (e.g., the forward side of the shroud 100), through the first portion 101, and into the second pin hole 107 of the second portion 103 when the first and second portions 101, 103 are sandwiched around the stator vanes 301 as shown in FIG. 4. In such an embodiment, the first pin hole 105 can have a larger diameter than the second pin hole 107 such that the pin 109 can be slid through the first pin hole 105 but press fit into the second pin hole 107 to secure the pin 109 within the shroud 100. Any other suitable pin securement (e.g., adhesives or threads) is contemplated herein.

Referring to FIG. 2, the second pin hole 107 can extend through the entire second portion 103 such that the pin 109 can be inserted from an outside surface of the second portion 103, through the second portion 103, and into the first pin hole 105 of the first portion 101 when the first and second portions 101, 103 are sandwiched around the stator vane 301. In such a circumstance, the second pin hole 107 can have a larger diameter than the first pin hole 105 such that the pin 109 can be slid through the second pin hole 107 but press fit into the first pin hole 105 to secure the pin 109 within the shroud 100. Any other suitable pin securement (e.g., adhesive, screw fit) is contemplated herein.

As will be appreciated by one having ordinary skill, any suitable number of pin holes 105, 107 (e.g., a third hole in the first portion, a fourth hole in the second portion, etc.) similar to the first and second pin holes 105, 107 as described above can be included in a single shroud 100 and can include any suitable number of shapes, sizes, and angles relative to each other. For example, the embodiments shown in FIG. 1 and FIG. 2 can be included on a single shroud 100 to have differing pin angles at different portions of the shroud 100.

Figure 2A:
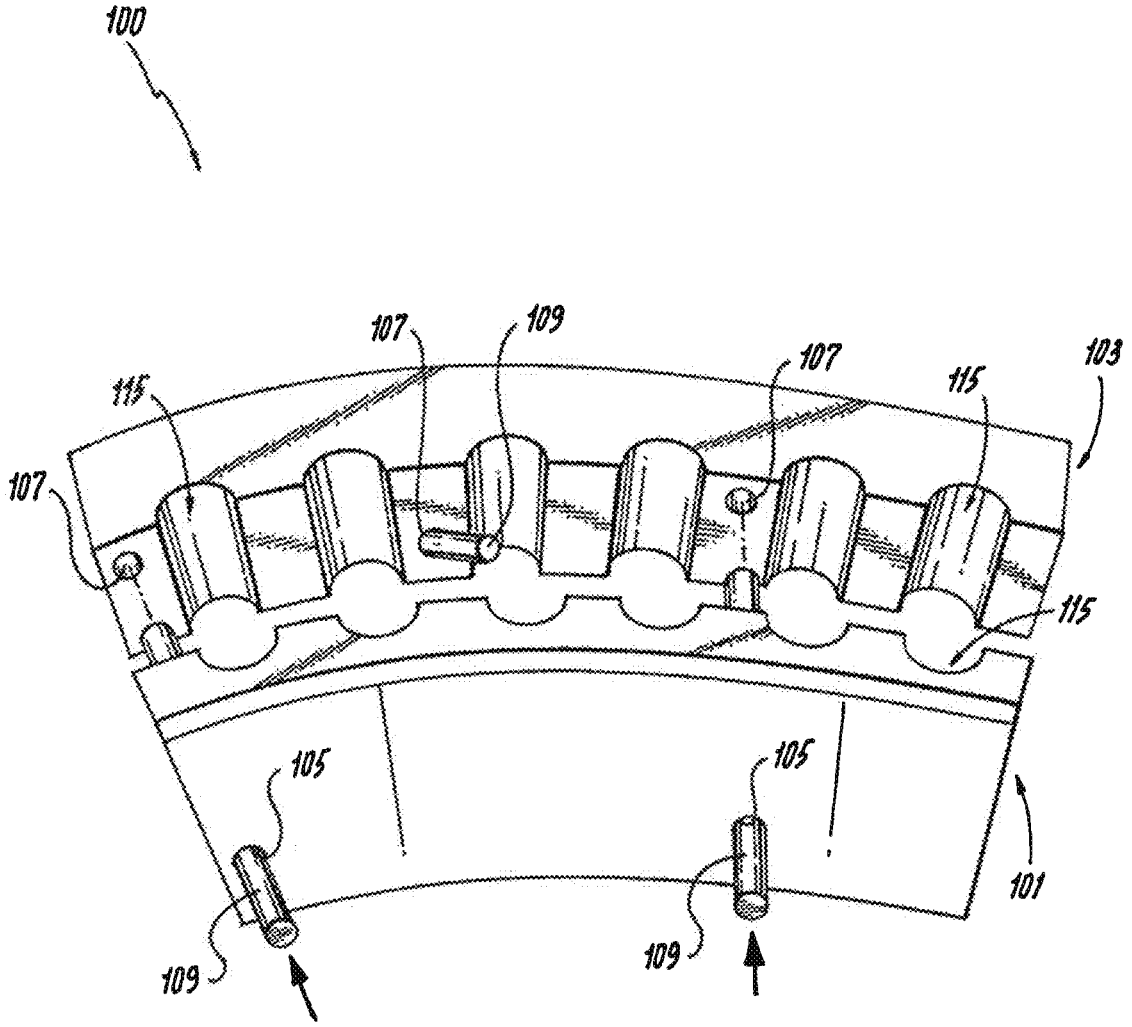
FIG. 2A is a partial, perspective, exploded view of the shroud of FIG. 1, showing the first portion separated from the second portion and pin holes aligned at both a first and second angle relative to a turbomachine axis and allowing pin insertion from both the forward and aft sides.

As stated above, in certain embodiments, a single angle for each pin hole 105, 107 can be utilized around the entire annulus of the shroud 100. In other embodiments, any suitable number of varying angles can be utilized. For example, in some embodiments, as shown in FIG. 2A, an alternating pin 109 configuration can exist such that pin holes alternate between two or more pin hole angles. As shown in FIG. 2A, some of the first pin holes 105 can require inserting a pin 109 from the forward side, and some second pin holes 107 can require inserting a pin from the aft side.

Referring to FIGS. 3 and 4, a stator assembly 300 is shown having a plurality of stator vanes 301 disposed in a casing 305. Each stator vane 301 includes a stator tip 303 that the shroud 100 is configured to wrap around or couple thereto. The stator vanes 301 can be a variable pitch vane or any other suitable vane (e.g., fixed vanes).

Additionally, as shown in FIG. 4, a suitable blocker 401 can be included around the shroud 100. Ends of the blocker 401 can fit within orifices 111, 113 to connect to the shroud 100. In certain embodiments, the blocker 401 can be shaped sheet metal or any other suitable blocking device. The blocker 401 can also include a seal member 403 disposed thereon for enhancing a seal between the shroud 100 and the rotating portion 500 of the turbomachine.

The pins 109 can take any suitable shape and/or size to be disposed within the pin holes 105, 107 as described above. The pins 109 can be made of a material with equal or greater thermal expansion than the first and second portions 101, 103 such that the pins 109 are prevented from slipping out of the first and second pin holes 105, 107 when the assembly expands or contracts under thermal action.

In at least one aspect of this disclosure, a method for assembling a shroud 100 for a turbomachine stator assembly 300 includes placing a first portion 101 and a second portion 103 of a shroud 100 together such that a plurality of first pin holes 105 of the first portion 101 align with a plurality of second pin holes 107 of the second portion 103 at an angle relative to axis A-A. The method also includes disposing a plurality of pins 109 within the first pin holes 105 and second pin holes 107.

Disposing the pins 109 can include inserting the pins 109 through the first pin hole 105 and into the second pin hole 107. In certain embodiments, disposing the pins 109 can include inserting the pins 109 through the second pin hole 107 and into the first pin hole 105. Placing the first and second portions 101, 103 together can include placing the first and second portions 101, 103 around a stator vane 301.

The methods and systems of the present disclosure, as described above and shown in the drawings, provide for a shroud for a turbomachine with superior properties including simplified assembly, smaller size, and lighter weight. While the apparatus and methods of the subject disclosure have been shown and described with reference to embodiments, those skilled in the art will readily appreciate that changes and/or modifications may be made thereto without departing from the scope of the subject disclosure.

What is claimed is:

1. A shroud for a turbomachine stator, comprising:
a first portion and a second portion configured to sandwich around at least a portion of a stator vane assembly;
a first pin hole defined in the first portion at an angle relative to an axial turbomachine direction; and
a second pin hole defined in the second portion at the angle of the first pin hole, wherein the first pin hole is aligned and in communication with the second pin hole to accommodate a pin configured to be seated in the first and second pin holes, wherein the first pin hole has a larger diameter than the second pin hole and the pin is slid through the first pin hole and press fit into the second pin hole when the pin is secured within the shroud.

2. The shroud of claim 1, wherein the first pin hole extends through the entire first portion such that the first pin hole extends from an outside surface of the first portion to the second pin hole of the second portion when the first and second portions are sandwiched around the at least a portion of the stator vane assembly.

3. The shroud of claim 1, wherein the second pin hole extends through the entire second portion such that the second pin hole extends from an outside surface of the second portion to the first pin hole of the first portion when the first and second portions are sandwiched around the at least a portion of the stator vane assembly.

4. The shroud of claim 1, wherein the first portion includes a third pin hole disposed therein and the second portion includes a fourth pin hole disposed therein, wherein the third pin hole is aligned and in communication with the fourth pin hole, wherein the third and fourth pin holes are disposed at a different angle than the first and second pin holes relative to the axial turbomachine direction.

5. The shroud of claim 4, wherein the first pin hole extends through the entire first portion such that the first pin hole extends from an outside surface of the first portion through the first portion and to the second pin hole of the second portion, and wherein the fourth pin hole extends through the entire second portion such that the fourth pin hole extends from an outside surface of the second portion through the second portion and to the third pin hole of the first portion when the first and second portions are sandwiched around the at least a portion of the stator vane assembly.

6. The shroud of claim 1, wherein the pin is made of a material with equal or greater thermal expansion than the first and second portions such that the pin is prevented from slipping out of the first and second pin holes when heated.

7. A shroud for a turbomachine stator, comprising:
a first portion and a second portion configured to sandwich around at least a portion of a stator vane assembly;
a first pin hole defined in the first portion at an angle relative to an axial turbomachine direction; and
a second pin hole defined in the second portion at the angle of the first pin hole, wherein the first pin hole is aligned and in communication with the second pin hole to accommodate a pin configured to be seated in the first and second pin holes, wherein the second pin hole extends through the entire second portion such that the second pin hole extends from an outside surface of the second portion to the first pin hole of the first portion when the first and second portions are sandwiched around the at least a portion of the stator vane assembly, and wherein the second pin hole has a larger diameter than the first pin hole and the pin is slid through the second pin hole and press fit into the first pin hole when the pin is secured within the shroud.

8. A method for assembling a shroud, comprising:
placing a first portion of the shroud and a second portion of the shroud together such that a portion of a stator vane assembly is sandwiched between the first portion of the shroud and the second portion of the shroud and a plurality of first pin holes extending completely through the first portion align with a plurality of second pin holes of the second portion, the plurality of first pin holes and the plurality of second pin holes aligning with each other at an angle inclined relative to a turbomachine axis; and
disposing a plurality of pins within the plurality of first pin holes and the plurality of second pin holes, the plurality of first pin holes having a larger diameter than a diameter of the plurality of second pin holes and wherein the plurality of pins are slidably received within the plurality of first pin holes and press fit into the plurality of second pin holes when they are disposed within the plurality of first pin holes and the plurality of second pin holes in order to secure the plurality of pins to the shroud.

9. The method of claim 8, wherein the step of disposing the plurality of pins within the plurality of first pin holes and the plurality of second pin holes includes first inserting the plurality of pins through the plurality of first pin holes and then into the plurality of second pin holes.

10. A shroud for a turbomachine stator, comprising:
a first portion and a second portion configured to sandwich around at least a portion of a stator vane assembly;
a plurality of first pin holes defined in the first portion, each first pin hole of the plurality of first pin holes being defined at an angle relative to an axial turbomachine direction; and
a plurality of second pin holes defined in the second portion, wherein each first pin hole of the plurality of first pin holes are aligned and in communication with each respective second pin hole of the plurality of second pin holes to accommodate one pin of a plurality of pins configured to be seated in the plurality of first and second pin holes, wherein each second pin hole of the plurality of second pin holes is defined at the angle of the respective first pin hole of the plurality of first pin holes and wherein at least one first pin hole of the plurality of first pin holes has a larger diameter than a respective second pin hole of the plurality of second pin holes and the pin of the plurality of pins is slidably received within the at least one first pin hole of the plurality of first pin holes while being press fit into the respective one of the plurality of second pin holes to secure the pin of the plurality of pins within the shroud.

11. The shroud of claim 10, wherein the plurality of first pin holes and their respective plurality of second pin holes are defined at a plurality of different angles relative to the axial turbomachine direction.

12. The shroud of claim 11, wherein a portion of the plurality of first pin holes and their respective plurality of second pin holes define a first pin hole arrangement that includes at least one of the plurality of first pin holes that extends from a forward side of the first portion and through the first portion and at least one of the plurality of second pin holes that extends from an aft side of the second portion and through the second portion.

13. The shroud of claim 12, wherein another portion of the plurality of first pin holes and their respective plurality of second pin holes define a second pin hole arrangement that includes at least one of the plurality of second pin holes that extends from an aft side of the second portion and through the second portion and at least one of the plurality of first pin holes that extends from a forward side of the first portion and through the first portion wherein the first pin hole arrangement and the second pin hole arrangement alternate circumferentially along the shroud.

14. The shroud of claim 12, wherein the at least one of the plurality of first pin holes that extends from the forward side of the first portion is positioned at a first angle with respect to the axial turbomachine direction and the at least one of the plurality of second pin holes that extends from the aft side of the second portion is positioned at a second angle with respect to the axial turbomachine direction, the second angle being different from the first angle.

* * * * *